US010198898B2

(12) United States Patent
Chun

(10) Patent No.: US 10,198,898 B2
(45) Date of Patent: Feb. 5, 2019

(54) GAMING CENTER ALLOWING SWITCHING BETWEEN GAMES BASED UPON HISTORICAL RESULTS

(71) Applicant: IGT, Las Vegas, NV (US)

(72) Inventor: Jay Chun, Hong Kong (CN)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 15/654,435

(22) Filed: Jul. 19, 2017

(65) Prior Publication Data

US 2017/0316637 A1 Nov. 2, 2017

Related U.S. Application Data

(63) Continuation of application No. 14/939,019, filed on Nov. 12, 2015, now abandoned, which is a continuation of application No. 14/525,419, filed on Oct. 28, 2014, now Pat. No. 9,214,060, which is a continuation of application No. 13/665,991, filed on Nov. 1, 2012, now Pat. No. 8,920,238, which is a continuation-in-part of application No. 11/897,590, filed on Aug. 31, 2007, now Pat. No. 8,323,105,
(Continued)

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/322* (2013.01); *G07F 17/3209* (2013.01); *G07F 17/3213* (2013.01); *G07F 17/3223* (2013.01); *G07F 17/3262* (2013.01); *G07F 17/3288* (2013.01); *G07F 17/3293* (2013.01); *G07F 17/34* (2013.01)

(58) Field of Classification Search

CPC .. G07F 17/32; G07F 17/3262; G07F 17/3211; A63F 2001/001; A63F 3/00157

USPC ..... 463/40–42, 16–25

See application file for complete search history.

(56) References Cited

U.S. PATENT DOCUMENTS

| | | | |
|---|---|---|---|
| 3,708,219 | A | 1/1973 | Forlini et al. |
| 3,998,309 | A | 12/1976 | Mandas et al. |

(Continued)

FOREIGN PATENT DOCUMENTS

| | | |
|---|---|---|
| EP | 0478412 | 4/1992 |
| GB | 2403429 | 7/2006 |

(Continued)

*Primary Examiner* — Masud Ahmed

(74) *Attorney, Agent, or Firm* — Neal, Gerber & Eisenberg LLP

(57) ABSTRACT

A gaming system comprising a plurality of betting terminals and a computer server comprising: a plurality of betting terminals for selecting and playing one or more live casino game(s) being played at a plurality of tables; each of the plurality of betting terminals has at least one first portion of a first screen for displaying the one or more live-casino game(s) to said player wherein the one or more live casino game(s) is a game offered in at least one casino resort, wherein a results history for each table is displayed in at least one first portion of a first screen to provide a results history display, and a switching mechanism for selecting, switching and playing one or more casino slot machine game(s) adapted to allow the player to switch between the live casino games according to at least the results history display for each table.

12 Claims, 15 Drawing Sheets

Related U.S. Application Data which is a continuation-in-part of application No. 11/800,885, filed on May 7, 2007, now Pat. No. 8,308,559, said application No. 13/665,991 is a continuation-in-part of application No. 13/042,633, filed on Mar. 8, 2011, now Pat. No. 9,940,777, which is a continuation of application No. 11/497,708, filed on Aug. 1, 2006, now Pat. No. 7,922,587, which is a continuation-in-part of application No. 11/312,150, filed on Dec. 19, 2005, now Pat. No. 7,914,368, and a continuation-in-part of application No. 11/198,218, filed on Aug. 5, 2005, now abandoned, and a continuation-in-part of application No. 11/042,732, filed on Jan. 24, 2005, now Pat. No. 7,918,723.

(56) References Cited

U.S. PATENT DOCUMENTS

| | | | |
|---|---|---|---|
| 4,095,795 | A | 6/1978 | Saxton |
| 4,333,715 | A | 6/1982 | Brooks |
| 4,337,945 | A | 7/1982 | Levy |
| 4,448,419 | A | 5/1984 | Telnaes |
| 4,467,424 | A | 8/1984 | Hedges et al. |
| 4,517,558 | A | 5/1985 | Davids |
| 4,607,844 | A | 8/1986 | Fullerton |
| 4,621,814 | A | 11/1986 | Stepan et al. |
| 4,659,182 | A | 4/1987 | Aizawa |
| 4,662,635 | A | 5/1987 | Enokian |
| 4,718,672 | A | 1/1988 | Okada |
| 4,805,907 | A | 2/1989 | Hagiwara |
| 4,856,787 | A | 8/1989 | Itkis |
| 4,858,932 | A | 8/1989 | Keane |
| 4,911,449 | A | 3/1990 | Dickinson et al. |
| 4,912,548 | A | 3/1990 | Shanker et al. |
| 5,086,354 | A | 2/1992 | Bass et al. |
| 5,113,272 | A | 5/1992 | Reamey |
| 5,132,839 | A | 7/1992 | Travis |
| 5,248,142 | A | 9/1993 | Breeding |
| 5,288,081 | A | 2/1994 | Breeding |
| 5,319,491 | A | 6/1994 | Selbrede |
| 5,325,830 | A | 7/1994 | Hammer |
| 5,342,047 | A | 8/1994 | Heidel et al. |
| 5,364,100 | A | 11/1994 | Ludlow et al. |
| 5,376,587 | A | 12/1994 | Buchmann et al. |
| 5,393,061 | A | 2/1995 | Manship et al. |
| 5,456,465 | A | 10/1995 | Durham |
| 5,467,893 | A | 11/1995 | Landis et al. |
| 5,472,194 | A | 12/1995 | Breeding et al. |
| 5,490,670 | A | 2/1996 | Hobert |
| 5,494,296 | A | 2/1996 | Grassa |
| 5,539,547 | A | 7/1996 | Ishii et al. |
| 5,544,892 | A | 8/1996 | Breeding |
| 5,580,055 | A | 12/1996 | Hagiwara |
| 5,580,310 | A | 12/1996 | Orus et al. |
| 5,585,821 | A | 12/1996 | Ishikura et al. |
| 5,586,937 | A | 12/1996 | Menashe |
| 5,588,650 | A | 12/1996 | Eman et al. |
| 5,589,980 | A | 12/1996 | Bass et al. |
| 5,611,730 | A | 3/1997 | Weiss |
| 5,613,909 | A | 3/1997 | Stelovsky |
| 5,618,232 | A | 4/1997 | Martin |
| 5,643,086 | A | 7/1997 | Alcorn et al. |
| 5,655,961 | A | 8/1997 | Acres et al. |
| 5,722,890 | A | 3/1998 | Libby et al. |
| 5,743,523 | A | 4/1998 | Kelly et al. |
| 5,743,798 | A | 4/1998 | Adams et al. |
| 5,745,197 | A | 4/1998 | Leung et al. |
| 5,752,881 | A | 5/1998 | Inoue |
| 5,752,882 | A | 5/1998 | Acres et al. |
| 5,759,103 | A | 6/1998 | Freels et al. |
| 5,762,552 | A | 6/1998 | Vuong et al. |
| 5,764,317 | A | 6/1998 | Sadovnik et al. |
| 5,766,076 | A | 6/1998 | Pease et al. |
| 5,772,509 | A | 6/1998 | Weiss |
| RE35,864 | E | 7/1998 | Weingardt |
| 5,782,692 | A | 7/1998 | Stelovsky |
| 5,788,574 | A | 8/1998 | Ornstein et al. |
| 5,791,992 | A | 8/1998 | Crump et al. |
| 5,795,225 | A | 8/1998 | Jones et al. |
| 5,797,795 | A | 8/1998 | Takemoto et al. |
| 5,800,268 | A | 9/1998 | Molnick |
| 5,803,451 | A | 9/1998 | Kelly et al. |
| 5,820,459 | A | 10/1998 | Acres et al. |
| 5,820,461 | A | 10/1998 | Pernatozzi |
| 5,830,067 | A | 11/1998 | Graves et al. |
| 5,836,817 | A | 11/1998 | Acres et al. |
| 5,839,730 | A | 11/1998 | Pike |
| 5,839,731 | A | 11/1998 | Feola |
| 5,851,149 | A | 12/1998 | Xidos et al. |
| 5,873,781 | A | 2/1999 | Keane |
| 5,885,085 | A | 3/1999 | Fujita |
| 5,888,136 | A | 3/1999 | Herbert |
| 5,910,046 | A | 6/1999 | Wada et al. |
| 5,911,626 | A | 6/1999 | McCrea, Jr. |
| 5,931,471 | A | 8/1999 | Bonito |
| 5,951,397 | A | 9/1999 | Dickinson |
| 5,956,180 | A | 9/1999 | Bass et al. |
| 5,967,893 | A | 10/1999 | Lawrence et al. |
| 6,001,016 | A | 12/1999 | Walker et al. |
| 6,015,346 | A | 1/2000 | Bennett |
| 6,019,374 | A | 2/2000 | Breeding |
| 6,027,115 | A | 2/2000 | Griswold et al. |
| 6,039,650 | A | 3/2000 | Hill |
| 6,050,895 | A | 4/2000 | Luciano et al. |
| 6,054,969 | A | 4/2000 | Haisma |
| 6,056,641 | A | 5/2000 | Webb |
| 6,059,658 | A | 5/2000 | Mangano et al. |
| 6,080,063 | A | 6/2000 | Khosla |
| 6,083,105 | A | 7/2000 | Ronin et al. |
| 6,113,493 | A | 9/2000 | Walker et al. |
| 6,135,884 | A | 10/2000 | Hedrick et al. |
| 6,142,876 | A | 11/2000 | Cumbers |
| 6,149,522 | A | 11/2000 | Alcorn et al. |
| 6,159,098 | A | 12/2000 | Slomiany et al. |
| 6,165,069 | A | 12/2000 | Sines et al. |
| 6,213,875 | B1 | 4/2001 | Suzuki |
| 6,244,596 | B1 | 6/2001 | Kondratjuk |
| 6,251,014 | B1 | 6/2001 | Stockdale et al. |
| 6,252,707 | B1 | 6/2001 | Kleinberger et al. |
| 6,254,481 | B1 | 7/2001 | Jaffe |
| 6,264,561 | B1 | 7/2001 | Saffari |
| 6,312,334 | B1 | 11/2001 | Yoseloff |
| 6,315,666 | B1 | 11/2001 | Mastera et al. |
| 6,336,857 | B1 | 1/2002 | McBride |
| 6,337,513 | B1 | 1/2002 | Clevenger et al. |
| 6,347,996 | B1 | 2/2002 | Gilmore et al. |
| 6,368,216 | B1 | 4/2002 | Hedrick et al. |
| 6,379,244 | B1 | 4/2002 | Sagawa et al. |
| 6,394,907 | B1 | 5/2002 | Rowe |
| 6,398,220 | B1 | 6/2002 | Inoue |
| 6,416,827 | B1 | 7/2002 | Chakrapani et al. |
| 6,435,970 | B1 | 8/2002 | Baerlocher et al. |
| 6,444,496 | B1 | 9/2002 | Edwards et al. |
| 6,445,185 | B1 | 9/2002 | Damadian et al. |
| 6,491,583 | B1 | 12/2002 | Gauselmann |
| 6,503,147 | B1 | 1/2003 | Stockdale et al. |
| 6,508,709 | B1 | 1/2003 | Karmarkar |
| 6,511,375 | B1 | 1/2003 | Kaminkow |
| 6,512,559 | B1 | 1/2003 | Hashimoto et al. |
| 6,514,141 | B1 | 2/2003 | Kaminkow et al. |
| 6,517,073 | B1 | 2/2003 | Vancura |
| 6,517,433 | B2 | 2/2003 | Loose et al. |
| 6,517,437 | B1 | 2/2003 | Wells et al. |
| 6,547,664 | B2 | 4/2003 | Saunders |
| 6,575,541 | B1 | 6/2003 | Hedrick et al. |
| 6,575,834 | B1 | 6/2003 | Lindo |
| 6,585,591 | B1 | 7/2003 | Baerlocher et al. |
| 6,607,195 | B2 | 8/2003 | Vancura |
| D480,961 | S | 10/2003 | Deadman |
| 6,646,695 | B1 | 11/2003 | Gauselmann |
| 6,652,378 | B2 | 11/2003 | Cannon et al. |
| 6,659,864 | B2 | 12/2003 | McGahn et al. |
| 6,661,425 | B1 | 12/2003 | Hiroaki |

(56) References Cited

U.S. PATENT DOCUMENTS 6,676,517 B2 1/2004 Beavers
6,685,567 B2 2/2004 Cockerille et al.
6,695,703 B1 2/2004 McGahn
6,702,675 B2 3/2004 Poole et al.
6,712,694 B1 3/2004 Nordman
6,715,756 B2 4/2004 Inoue
6,717,728 B2 4/2004 Putilin
6,722,979 B2 4/2004 Gilmore et al.
6,726,565 B2 4/2004 Hughs-Baird
6,789,801 B2 9/2004 Snow
6,802,777 B2 10/2004 Seelig et al.
6,804,763 B1 10/2004 Stockdale et al.
6,817,945 B2 11/2004 Seelig et al.
6,817,946 B2 11/2004 Motegi et al.
6,863,608 B1 3/2005 LeMay et al.
6,866,586 B2 3/2005 Oberberger et al.
6,887,157 B2 5/2005 LeMay et al.
6,890,259 B2 5/2005 Breckner et al.
6,906,762 B1 6/2005 Witehira et al.
6,937,298 B2 8/2005 Okada
7,008,319 B2 * 3/2006 Montgomery et al. ..... 463/21
7,029,395 B1 4/2006 Baerlocher
7,128,647 B2 10/2006 Muir
7,204,753 B2 4/2007 Ozaki et al.
7,220,181 B2 5/2007 Okada
7,252,288 B2 8/2007 Seelig et al.
7,255,643 B2 8/2007 Ozaki et al.
7,303,473 B2 12/2007 Rowe
7,309,065 B2 * 12/2007 Yoseloff et al. ..... 273/292
7,309,284 B2 12/2007 Griswold et al.
7,322,884 B2 1/2008 Emori et al.
7,326,115 B2 2/2008 Baerlocher
7,329,179 B2 2/2008 Baerlocher
7,329,181 B2 2/2008 Hoshino et al.
7,351,146 B2 4/2008 Kaminkow
7,387,570 B2 6/2008 Randall
7,452,270 B2 11/2008 Walker et al.
7,465,227 B2 12/2008 Baerlocher
7,470,185 B2 12/2008 Baerlocher
7,488,251 B2 2/2009 Kaminkow
7,503,849 B2 3/2009 Hornik et al.
7,537,456 B2 5/2009 Snow
7,566,274 B2 7/2009 Johnson et al.
7,575,512 B2 8/2009 Kennedy
7,591,726 B2 9/2009 Baerlocher et al.
7,618,319 B2 11/2009 Casey et al.
7,666,086 B2 2/2010 Baerlocher
7,666,087 B2 2/2010 Hughs-Baird
7,699,698 B2 4/2010 Randall
7,753,798 B2 7/2010 Soltys et al.
7,758,419 B2 7/2010 Rowe et al.
7,775,524 B2 8/2010 Lutnick et al.
7,789,743 B2 9/2010 Walker et al.
7,819,744 B2 10/2010 Hughs-Baird
7,822,641 B2 10/2010 Abbott et al.
7,828,643 B2 11/2010 Baerlocher
7,837,547 B2 11/2010 Cannon
7,846,018 B2 12/2010 Baerlocher
7,867,077 B2 1/2011 Baerlocher et al.
7,878,892 B2 2/2011 Sines et al.
7,905,771 B2 3/2011 Walker et al.
7,905,774 B2 3/2011 Walker et al.
7,914,372 B2 3/2011 Tessmer et al.
7,931,531 B2 4/2011 Oberberger
7,950,993 B2 5/2011 Oberberger
7,963,845 B2 6/2011 Baerlocher
7,967,674 B2 6/2011 Baerlocher
7,976,378 B2 7/2011 Baerlocher
7,980,948 B2 7/2011 Rowe et al.
8,020,866 B2 9/2011 Walker et al.
8,066,564 B2 11/2011 Randall
8,087,999 B2 1/2012 Oberberger et al.
8,109,821 B2 2/2012 Kovacs et al.
8,128,491 B2 3/2012 Vasquez et al.
8,128,492 B2 3/2012 Vasquez et al.
8,152,624 B2 4/2012 Gerrard et al.
8,152,629 B2 4/2012 DeWaal et al.
8,167,711 B2 5/2012 Baerlocher
8,172,660 B2 5/2012 Lancaster et al.
8,177,627 B2 5/2012 Baerlocher
8,182,323 B2 5/2012 Okada
8,197,335 B2 6/2012 DeWaal et al.
8,202,153 B2 6/2012 Baerlocher
8,206,212 B2 6/2012 Iddings et al.
8,231,456 B2 7/2012 Zielinski
8,235,801 B2 8/2012 Tan
8,267,765 B2 9/2012 Baerlocher
8,305,550 B2 11/2012 Jung et al.
8,313,373 B2 11/2012 Walker et al.
8,317,589 B2 11/2012 Tessmer et al.
8,342,954 B2 1/2013 Oberberger et al.
8,360,852 B2 1/2013 Randall
8,360,859 B2 1/2013 Walker et al.
8,403,740 B2 3/2013 Kovacs et al.
8,425,305 B2 4/2013 Baerlocher et al.
8,430,735 B2 4/2013 Oberberger
8,430,739 B2 4/2013 Rodgers
8,454,427 B2 6/2013 Baerlocher
8,460,095 B2 6/2013 Tan
8,474,820 B2 7/2013 Walker et al.
8,485,888 B2 7/2013 Baerlocher
8,496,521 B2 7/2013 Randall
8,500,533 B2 8/2013 Lutnick et al.
8,506,380 B2 8/2013 Hughes et al.
8,517,824 B2 8/2013 Zielinski et al.
8,613,650 B2 12/2013 Kovacs et al.
9,135,775 B2 9/2015 Pececnik
9,214,056 B2 12/2015 Kovacs et al.
2001/0013681 A1 8/2001 Bruzzese et al.
2002/0045472 A1 4/2002 Adams
2002/0068635 A1 6/2002 Hill
2002/0077712 A1 6/2002 Safaei et al.
2002/0094869 A1 7/2002 Harkham
2002/0173354 A1 11/2002 Winans et al.
2003/0027624 A1 2/2003 Gilmore et al.
2003/0032478 A1 2/2003 Takahama et al.
2003/0032479 A1 2/2003 LeMay et al.
2003/0060271 A1 3/2003 Gilmore et al.
2003/0073497 A1 4/2003 Nelson
2003/0087690 A1 5/2003 Loose et al.
2003/0130028 A1 7/2003 Aida et al.
2003/0176214 A1 9/2003 Burak et al.
2003/0203756 A1 10/2003 Jackson
2003/0224854 A1 12/2003 Joao
2003/0234489 A1 12/2003 Okada
2003/0236114 A1 12/2003 Griswold et al.
2003/0236118 A1 12/2003 Okada
2004/0002379 A1 1/2004 Parrott et al.
2004/0023714 A1 2/2004 Asdale
2004/0029636 A1 2/2004 Wells
2004/0063490 A1 4/2004 Okada
2004/0066475 A1 4/2004 Searle
2004/0070146 A1 4/2004 Snow
2004/0084843 A1 5/2004 Snow
2004/0087357 A1 * 5/2004 Johnson ..... 463/17
2004/0090003 A1 5/2004 Snow
2004/0090005 A1 5/2004 Snow
2004/0116178 A1 6/2004 Okada
2004/0116179 A1 * 6/2004 Nicely et al. ..... 463/25
2004/0145116 A1 7/2004 Calvo et al.
2004/0147303 A1 7/2004 Imura et al.
2004/0147314 A1 7/2004 LeMay et al.
2004/0150162 A1 8/2004 Okada
2004/0162146 A1 8/2004 Ooto
2004/0166925 A1 8/2004 Emori et al.
2004/0171423 A1 9/2004 Silva et al.
2004/0183972 A1 9/2004 Bell
2004/0192430 A1 9/2004 Burak et al.
2004/0198485 A1 10/2004 Loose et al.
2004/0207154 A1 10/2004 Okada
2004/0209666 A1 10/2004 Tashiro
2004/0209667 A1 10/2004 Emori et al.
2004/0209668 A1 10/2004 Okada
2004/0209671 A1 10/2004 Okada

(56) References Cited

U.S. PATENT DOCUMENTS

2004/0209678 A1 10/2004 Okada
2004/0209683 A1 10/2004 Okada
2004/0214635 A1 10/2004 Okada
2004/0214637 A1 10/2004 Nonaka
2004/0224747 A1 11/2004 Okada
2004/0233663 A1 11/2004 Emslie et al.
2004/0235542 A1* 11/2004 Stronach et al. ..... 463/6
2004/0239582 A1 12/2004 Seymour
2005/0003886 A1 1/2005 Englman et al.
2005/0032571 A1 2/2005 Asonuma
2005/0037843 A1 2/2005 Wells et al.
2005/0049032 A1 3/2005 Kobayashi
2005/0049046 A1 3/2005 Kobayashi
2005/0062410 A1 3/2005 Bell et al.
2005/0063055 A1 3/2005 Engel
2005/0079913 A1 4/2005 Inamura
2005/0085292 A1 4/2005 Inamura
2005/0153772 A1 7/2005 Griswold et al.
2005/0153775 A1 7/2005 Griswold et al.
2005/0176493 A1 8/2005 Nozaki et al.
2005/0176507 A1 8/2005 Ephrati et al.
2005/0192090 A1 9/2005 Muir et al.
2005/0192099 A1 9/2005 Nguyen et al.
2005/0206582 A1 9/2005 Bell et al.
2005/0208994 A1 9/2005 Berman
2005/0233799 A1 10/2005 LeMay et al.
2005/0233803 A1 10/2005 Yang
2005/0239539 A1 10/2005 Inamura
2005/0266912 A1 12/2005 Sekiguchi
2005/0282625 A1 12/2005 Nicely
2005/0285337 A1 12/2005 Durham et al.
2006/0030399 A1 2/2006 Baerlocher
2006/0040733 A1 2/2006 Baerlocher
2006/0073882 A1 4/2006 Rozkin et al.
2006/0092170 A1 5/2006 Bathiche et al.
2006/0100014 A1 5/2006 Griswold et al.
2006/0103951 A1 5/2006 Bell et al.
2006/0125745 A1 6/2006 Evanicky
2006/0135240 A1 6/2006 Barshack
2006/0166727 A1 7/2006 Burak
2006/0166731 A1* 7/2006 Yoshimi et al. ..... 463/20
2006/0189382 A1 8/2006 Muir et al.
2006/0191177 A1 8/2006 Engel
2006/0258446 A1 11/2006 Nguyen et al.
2006/0284574 A1 12/2006 Emslie et al.
2006/0287058 A1* 12/2006 Resnick et al. ..... 463/19
2006/0290594 A1 12/2006 Engel et al.
2007/0004510 A1 1/2007 Underdahl et al.
2007/0010315 A1 1/2007 Hein
2007/0021198 A1 1/2007 Muir et al.
2007/0129123 A1 6/2007 Eryou et al.
2007/0135204 A1* 6/2007 Nicely ..... 463/17
2007/0155512 A1* 7/2007 Wells et al. ..... 463/46
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0045288 A1* 2/2008 Moshal et al. ..... 463/16
2008/0064467 A1 3/2008 Reiner
2008/0085769 A1* 4/2008 Lutnick et al. ..... 463/41
2008/0146344 A1 6/2008 Rowe et al.
2008/0149705 A1 6/2008 Giobbi et al.
2008/0182650 A1 7/2008 Randall et al.
2008/0231611 A1 9/2008 Bathiche et al.
2008/0248865 A1 10/2008 Tedesco et al.
2008/0254881 A1* 10/2008 Lutnick et al. ..... 463/31
2008/0305855 A1 12/2008 Czyzewski et al.
2008/0318668 A1 12/2008 Ching et al.
2009/0029766 A1 1/2009 Lutnick et al.
2009/0111573 A1 4/2009 Iddings
2010/0111820 A1 5/2010 Natura et al.
2010/0120506 A1 5/2010 Davis et al.
2010/0130280 A1 5/2010 Arezina et al.
2010/0234086 A1 9/2010 Michaelson
2011/0111824 A1 5/2011 Cuddy et al.
2012/0004037 A1 1/2012 Hill

FOREIGN PATENT DOCUMENTS

WO WO 99/19027 4/1999
WO WO 99/42889 8/1999
WO WO 99/44095 9/1999
WO WO 01/09664 2/2001
WO WO 01/15127 3/2001
WO WO 01/15128 3/2001
WO WO 01/15132 3/2001
WO WO 2004/001486 12/2003
WO WO 2004/102520 11/2004
WO WO 2006/034192 3/2006
WO WO 2006/038819 4/2006
WO WO 2007/032945 3/2007
WO WO 2007/073534 6/2007

* cited by examiner

FIGURE 13A
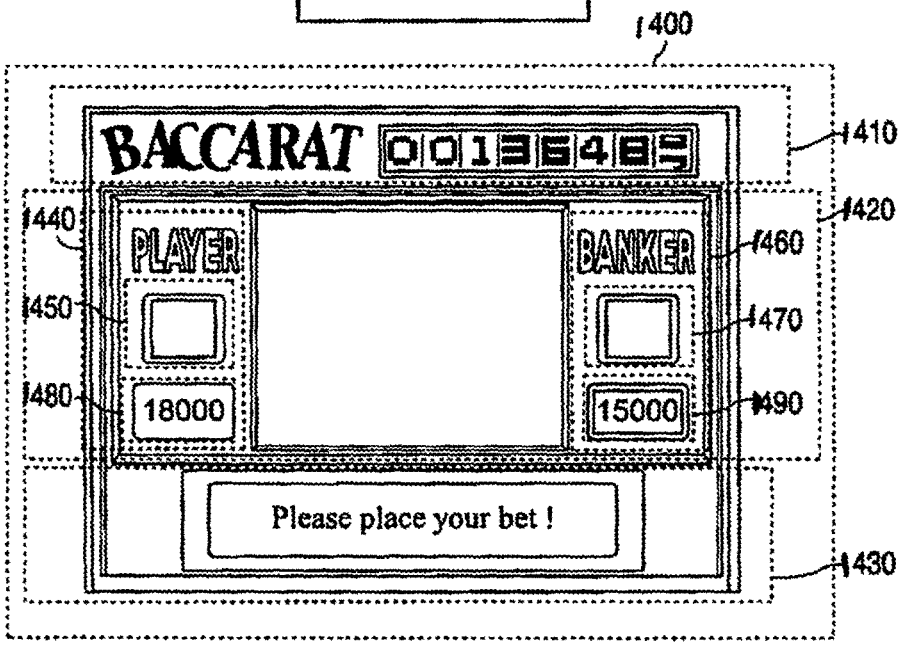
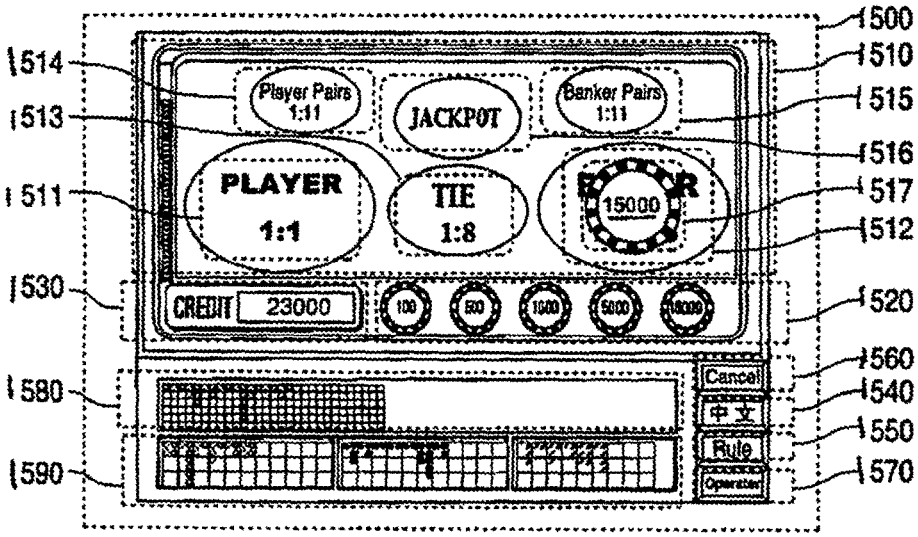
Figure 13B

GAMING CENTER ALLOWING SWITCHING BETWEEN GAMES BASED UPON HISTORICAL RESULTS

PRIORITY CLAIM

This application is a continuation of, claims the benefit of and priority to U.S. patent application Ser. No. 14/939,019, filed on Nov. 12, 2015, which is a continuation of, claims the benefit of and priority to U.S. patent application Ser. No. 14/525,419, filed on Oct. 28, 2014, which is a continuation of, claims the benefit of and priority to U.S. patent application Ser. No. 13/665,991 filed on Nov. 1, 2012, which is a continuation-in-part of, claims the benefit of and priority to U.S. patent application Ser. No. 11/897,590 filed on Aug. 31, 2007, which is a continuation-in-part of, claims the benefit of and priority to U.S. patent application Ser. No. 11/800,885, filed on May 7, 2007, and which is a continuation-in-part of, claims the benefit of and priority to U.S. patent application Ser. No. 13/042,633 filed on Mar. 8, 2011, which is a continuation of, claims the benefit of and priority to U.S. patent application Ser. No. 11/497,708 filed on Aug. 1, 2006, which is a continuation-in-part of, claims the benefit of and priority to U.S. patent application Ser. No. 11/312,150 filed on Dec. 19, 2005, and which is a continuation-in-part of, claims the benefit of and priority to U.S. patent application Ser. No. 11/198,218, filed on Aug. 5, 2005, and which is a continuation-in-part of, claims the benefit of and priority to U.S. patent application Ser. No. 11/042,732, filed on Jan. 24, 2005, the entire contents of which are each incorporated by reference herein.

BACKGROUND OF THE INVENTION

The present invention is generally directed to a gaming system that allows a player to select and play one or more live casino game(s) such as a live baccarat game and/or a non-live casino game(s).

In casino games, such as the baccarat game, there is generally a count-down time during which a player of the game will need to wait for the count-down result. This waiting period results in frustration of the player, waste of the resource of the gaming establishment, and, as the result, reduced revenue by the gaming establishment.

Additionally, casino games are generally ad hoc in nature. Games in a casino resort are generally played around the resort in several locations. Player(s) therefore have to go around the casino resort to select, view or play casino games. This also leads to waste of time, and, as the result, reduced revenue by the gaming establishment.

The embodiments described below address the above-described issues and needs.

SUMMARY OF THE INVENTION

The present invention provides a centralized gaming center in a casino resort. The gaming system comprises a computer server and a cabinet that allows a player to play any one or more games the player selects. All the games in one casino resort or several casino resorts can be linked to the computer server via a network. The network can be wired network or wireless network. The cabinet can include one, two, three, four, or several screens for displaying live casino games or non-live casino games. The cabinet can also include features such as key pads or key boards allowing a player to select a desired game or desired games and features common in a casino gaming terminal.

In some embodiments, the gaming system or gaming center allows a player to play a baccarat game and one or more other casino game. The one or more other casino games can be another baccarat game or a non-baccarat game. In some embodiments, the non-baccarat game can be a slot machine game, a casino card game, or a felt-table games. In some embodiments, the casino games are live casino games such as a baccarat game, a Sic Bo game, a Roulette game, a Fish-Prawn-Crab game, or a Wheel of Fortune game. In some embodiments, the casino game can be a non-live casino game such as a slot machine game. In some embodiments, the casino game can be video server based games including video slot games and other form of video games while players could also use many forms of mechanism including using touch screen mechanism to participate in the process.

In some embodiments, the main cabinet, or betting terminal, comprises a upper screen and a lower screen for playing the live casino game described above. The screen for displaying the non-live casino game, e.g., slot machine game, can be stand-alone screen or can be connected to the main cabinet. The screen for displaying the slot machine game can be fixed or foldable. In some embodiments, the screen for displaying the slot machine game is connected to the main cabinet, e.g., either connected to the upper screen or connected to the lower screen through a connection mechanism. The connection mechanism can be a hinge(s) or an arm(s). In some embodiments, the connection mechanism is integrated extension of the main cabinet, e.g., the upper or the lower screen. In some embodiments, the connection mechanism comprises hinge(s) (e.g., one, two, three or more hinges), allowing the screen for displaying the non-live casino game such as slot machine game to be folded to the main cabinet to cover up the upper screen or the lower screen. In some embodiments, the connection mechanism comprises a metallic arm or metallic arm(s) (e.g., one, two, three, or more arms).

In some embodiments, the screen for displaying a non-live casino game such as slot machine game and/or the live casino game such as live baccarat game can also allow the playing of non-live casino game such as slot machine games or baccarat games based on a stand alone server.

The mechanism for playing a casino game is well known in the art of gaming. Systems (e.g., devices and apparatus) or parts or components thereof embodying such gaming mechanism or a part thereof is either commercially available or can be readily constructed or built by an ordinary artisan.

In some embodiments, the present invention also provides a software program or a set of software programs for carrying out any or all steps of the betting method described herein. The gaming system can also be incorporated into an electronic device or an entertainment gaming machine. Representative electronic devices include, but are not limited to, laptop computers or desktop computers.

BRIEF DESCRIPTION OF DRAWINGS

FIGS. 13A, 13B and 13C show an embodiment of the present invention.

DETAILED DESCRIPTION

Figures 1A, 1B, 1C, 1D, 1E, 1F:
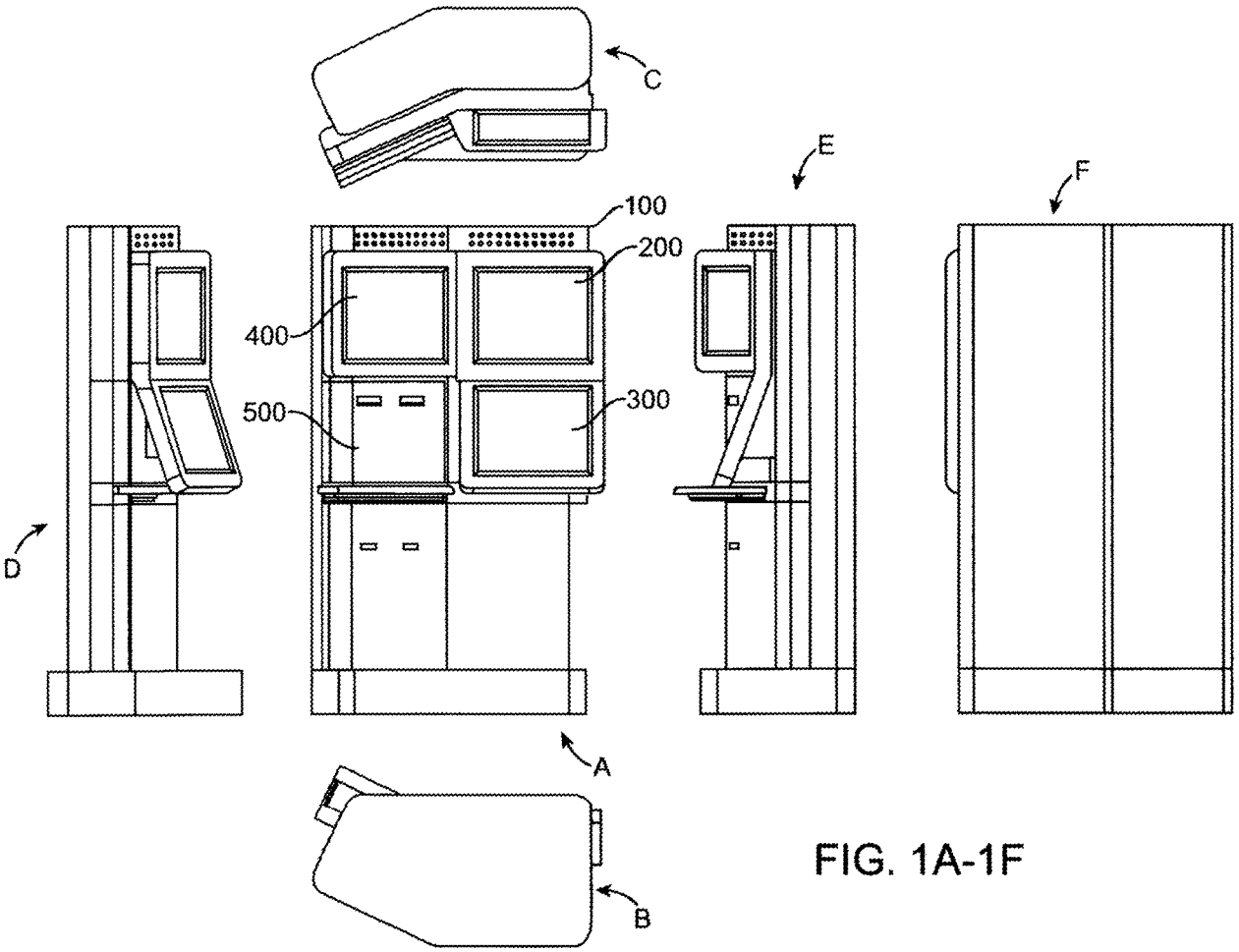
FIGS. 1A-1F shows an embodiment of the present invention.

The present invention provides a centralized gaming center in a casino resort. The gaming system comprises a computer server and a cabinet that allows a player to play any one or more games the player selects. All the games in one casino resort or several casino resorts can be linked to the computer server via a network. The network can be wired network or wireless network. The cabinet can include one, two, three, four, or several screens for displaying live casino games or non-live casino games. The cabinet can also include features such as key pads or key boards allowing a player to select a desired game or desired games and features common in a casino gaming terminal.

In some embodiments, the gaming center includes a Paradise Box Gaming System as described in U.S. application Ser. No. 11/800,885 with the server described above installed in the Paradise Box Gaming System.

In some embodiments, the gaming system or gaming center allows a player to play a baccarat game and one or more other casino game. In some embodiments, the gaming system includes a computer server. The one or more other casino games can be another baccarat game or a non-baccarat game. In some embodiments, the non-baccarat game can be a slot machine game, a casino card game, or a felt-table games. In some embodiments, the casino games are live casino games such as a baccarat game, a Sic Bo game, a Roulette game, a Fish-Prawn-Crab game, or a Wheel of Fortune game. In some embodiments, the casino game can be a non-live casino game such as a slot machine game. In some embodiments, the casino game can be video server based games including video slot games and other form of video games while players could also use many forms of mechanism including using touch screen mechanism to participate in the process.

In some embodiments, the main cabinet comprises a upper screen and a lower screen for playing the live casino game described above. The screen for displaying the non-live casino game, e.g., slot machine game, can be stand-alone screen or can be connected to the main cabinet. The screen for displaying the slot machine game can be fixed or foldable. In some embodiments, the screen for displaying the slot machine game is connected to the main cabinet, e.g., either connected to the upper screen or connected to the lower screen through a connection mechanism. The connection mechanism can be a hinge(s) or an arm(s). In some embodiments, the connection mechanism is integrated extension of the main cabinet, e.g., the upper or the lower screen. In some embodiments, the connection mechanism comprises hinge(s) (e.g., one, two, three or more hinges), allowing the screen for displaying the non-live casino game such as slot machine game to be folded to the main cabinet to cover up the upper screen or the lower screen. In some embodiments, the connection mechanism comprises a metallic arm or metallic arm(s) (e.g., one, two, three, or more arms).

In some embodiments, the screen for displaying a non-live casino game such as slot machine game and/or the live casino game such as live baccarat game can also allow the playing of non-live casino game such as slot machine games or baccarat games based on a stand alone server.

The mechanism for playing a casino game is well known in the art of gaming. Systems (e.g., devices and apparatus) or parts or components thereof embodying such gaming mechanism or a part thereof is either commercially available or can be readily constructed or built by an ordinary artisan.

In some embodiments, the present invention also provides a software program or a set of software programs for carrying out any or all steps of the betting method described herein. The gaming system can also be incorporated into an electronic device or an entertainment gaming machine. Representative electronic devices include, but are not limited to, laptop computers or desktop computers.

The rules of playing each casino game is well known in the art and well documented. Sometimes, rules for a game can be provided by gaming authorities. For examples, Macao Special Administrative Region the Gaming Inspection and Coordination Bureau of Macao Special Administrative Region, China, provides rules for rules for each casino games played in the region (http://www.dicj.gov.mo/CH/index.htm).

Rules for a few representative casino games are described below.

Live Baccarat Game

Baccarat games are common casino games. The object of baccarat is for the bettor to successfully wager on whether the banker's hand or the player's hand is going to win. The bettor receives even money for his wager if he selects the winning hand and loses his wager if he selects the losing hand. Because of the rules of play of baccarat, the banker's hand has a slightly higher chance of winning than does the player's hand. Therefore, if the bettor wagers on the banker's hand, the bettor is required to pay to the gaming establishment a commission (typically 5%) of the amount the bettor wins. No commission is paid if the bettor successfully wagers on the player's hand.

Conventional methods of playing baccarat are described as follows:

A multiple number of decks of standard playing cards, 52 in number, are used; typically six to twelve decks are shuffled together and placed in a shoe from which the cards are dealt during the play of the game.

Each bettor makes a wager on whether the banker's hand or the player's hand will win. After all wagers are made, two cards are dealt from the shoe to the bank position and two cards are dealt from the shoe to the player's position on the table layout. The cards are turned face up and the value of the banker's hand and the players hand is determined.

Aces count as one; kings, queens, jacks and tens count as zero and the other cards count as their respective face value. The suits (hearts, diamonds, spades and clubs) have no meaning in baccarat. The highest hand value in baccarat is nine. All hand values range from a low of zero to a high of nine. If when the cards are added together, the total of the hand exceeds nine, then the hand value is determined by subtracting ten from the total of the hand. For example, a seven and nine total sixteen, but the hand value is six. An Ace and a nine total ten, but the hand value is zero.

A two card total of eight or nine is called a "natural"; a two card total of zero is called a "baccarat". As will be explained hereafter, in certain situations in the play of the game, a third card will be dealt. The value of this third card is added to the total of the first two cards and a new hand value is established. Again, if the new hand total exceeds nine, the hand value is determined by subtracting ten from the total of the hand. Wagering locations are provided on the baccarat table layout. Whichever of the banker's hand or the players hand is closest to a total of nine is the winner.

The way of betting may differ in different gaming establishments. In the U.S., for example, prior to the deal, each bettor can make one of three wagers: 1) that the banker's hand will win, 2) that the player's hand will win, or 3) that the bather's hand and the player's hand will tie. In Macau, for example, one can make one of five wagers: 1) that the bathers hand will win, 2) that the player's hand will win, 3) that the banker's hand and the player's hand will tie, 4) that the first two cards in the banker's hand are of the same kind, regardless of the type of suit, forming a Bank Pair, or (5) that the first two cards in the player's hand are of the same kind, regardless of the type of suit, forming a Player Pair.

All winning bathers hand wagers in scenario 1) in both the U.S. and Macau are paid off at odds of one-to-one and the house charges a five percent (5%) commission on the amount won by the bettor. For example, if a bettor wagers $100 on the bathers hand and the banker's hand wins, the bettor wins $100 and is charged a $5 commission on the amount that the bettor won. The bettor is not charged any commission on the amount of his wager.

All wagers that select winning player's hand in scenario 2) in both the U.S. and Macau are paid off at odds of one-to-one and the bettor is not charged any commission on the amount of his winnings or his wager.

All winning wagers on the tie in scenario 3) in both the U.S. and Macau can be paid off at odds of eight-to-one (depending on the gaming establishment) and the bettor is not charged any commission on the amount of his winnings or his wager. If a tie hand occurs, all wagers on the banker's hand and all wagers on the player's hand are "pushes" and the amount wagered is returned to the bettor.

All winning wagers on the Bath Pair bet in scenario 4) in Macau can be paid off at odds of eleven-to-one (depending on the gaming establishment) and the bettor is not charged any commission on the amount of his winnings or his wager.

All winning wagers on the Player Pair bet in scenario 5) in Macau can be paid off at odds of eight-to-one (depending on the gaming establishment) and the bettor is not charged any commission on the amount of his winnings or his wager.

The play of baccarat typically uses three casino dealers to operate the game. The casino dealers jointly participate in the shuffling of the decks of cards. After the shuffle is completed, one of the players is typically asked to cut the decks using a plastic cut card. The dealer then separates and restacks the cards from the point of the cut and the dealer or a player then inserts the plastic cut card no less than fifteen cards (in Las Vegas, U.S.) or no less than twelve cards (in Macau) from the ends of the stacked decks and the entire stacked decks are placed into a shoe from which the cards are dealt during the play of the game. When the inserted plastic cut card appears during play, the hand in progress is completed and that round of play then ends. The cards are reshuffled to prepare for the next round of baccarat.

In conventional baccarat, the bettors deal the cards used in the game. Initially, one of the casino dealers (called the "caller") passes the shoe to the bettor sitting in seat number "1" at the baccarat table. After all wagers have been made, the caller tells the bettor with the shoe to begin the deal. The bettor deals a first card to the caller, a first card to himself, a second card to the caller and a second card to himself. All cards are dealt face down. The two cards given to the caller represent the player's hand and the two cards kept by the bettor who is dealing the cards represent the banker's hand.

The caller than allows one of the other bettors to turn up the player's hand. Traditionally, this honor is given to the bettor who has made the largest wager.

The bettor turns up the two cards of the player's hand and tosses them to the caller. The caller places these two cards face up in the table location designated for the "player's hand" and the caller announces the point total of the player's hand.

The bettor who has the shoe then turns over the cards of the bather's hand and tosses these two cards to the caller. The caller places these two cards face up in the table location designated for the "banker's hand" and the caller announces to point total of the banker's hand. Depending on the point total of the players hand and the banker's hand, one more card may be dealt to either the players hand, the bankers hand, or both. The rules for determining whether a third card is dealt are fixed rules, there is no discretion for either the player's hand or the bather's hand on whether a third card is dealt.

If either the player's hand or the banker's hand has a point total of eight or nine on the first two cards, no third card is dealt to either hand and the hand with the highest point total is the winner (or the hand is a tie, as the case may be). If none of the player's hand or the bather's hand has a point total of eight or nine, then there is a possibility of a third card draw.

The third card draw rules are as follows:

Rule #1: If the initial two card player's hand has a point total of 0, 1, 2, 3, 4 or 5, draws a third card. If the initial two card player's hand has a point total of 6 or 7, the player's hand stands and does not receive a third card.

Rule #2: If the player's hand stands and does not draw a third card, then the bather's hand follows Rule #1. In other words, if the players hand has a point total of 6 or 7, the bather's hand draws a third card on a point total of 0, 1, 2, 3, 4 or 5 and the bather's hand stands on a point total of 6 or 7.

Rule #3: If the player's hand draws a third card, the bathers hand must draw or stand as described in Table 1.

TABLE 1

| Bank hand two card point total | Bank hand draws when the player's hand third card is: | Bank hand stands when the player's hand third card is: |
|---|---|---|
| 0, 1 or 2 | Bank always draws | |
| 3 | 0, 1, 2, 3, 4, 5, 6, 7 or 9 | 8 |
| 4 | 2, 3, 4, 5, 6 or 7 | 0, 1, 8 or 9 |
| 5 | 4, 5, 6 or 7 | 0, 1, 2, 3, 8 or 9 |

TABLE 1-continued

| Bank hand two card point total | Bank hand draws when the player's hand third card is: | Bank hand stands when the player's hand third card is: |
|---|---|---|
| 6 | 6 or 7 | 0, 1, 2, 3, 4, 5, 8 or 9 |
| 7 | | Bank always stands |

All third card draw determinations are automatically made by the caller who is skilled in the game of baccarat. When the rules of baccarat require a third card for the player's hand, the caller will request a card for the player's hand. After the player's hand is completed, the bather's hand is completed in the same fashion. The caller then declares which hand has the highest point total and declares that hand the winner (or the caller declares a tie hand as the case may be).

In conventional baccarat the bettor who acts as the dealer continues to deal the cards until the player's hand wins. As soon as the player's hand wins, it is customary to pass the shoe counterclockwise around the baccarat table to the next bettor so that each bettor has the opportunity to deal the cards. Any bettor may decline to deal the cards. The fact that one of the bettors is physically dealing the cards has no affect on the outcome of the game because the rules for drawing and standing do not allow any discretion on the part of the players. The conventional baccarat rules can vary in different gaming jurisdictions. For example, in Macao, all other felt games must be handled by licensed and registered persons.

The players can play the game according to conventional baccarat rules, which may vary from place to place. In one embodiment, the baccarat game is played according to the U.S. rules as used in Las Vegas.

In another embodiment, the baccarat game is played according to the baccarat rules promulgated by the government of Macau Special Administration Region. In Macao, only dealers are eligible to touch the shoe at all time unless on very special situation in VIP rooms. In live baccarat game in Macau, all cards are being handled by licensed and registered dealers representing the concessionary holders (e.g., one of the 6 concessionary holders in Macao, namely, SJM, Galaxy, MGM, LVS etc).

Roulette

Roulette games are generally grouped into two categories: the European Roulette or English Roulette or the American Roulette. The following provides a general description of the game of Roulette and the rules playing the game.

American Roulette

The Wheel

The game of American Roulette is played on a wheel which consists of thirty-eight slots, each with its own number. The numbers on a Roulette wheel are 1-36, 0, and 00. The numbers alternate pairs of odd numbers with pairs of even numbers. The numbers also alternate between black and red. Both the 0 and 00 slots are green. A dealer, or croupier spins the wheel in one direction and then rolls a small ball in the other direction. The ball then drops into one of the slots as it begins to slow down.

The Table

The table is designed so that the numbers, not including 0 and 00, are lined up into three columns, each of twelve numbers, the first row is 1, 2, 3; the second row is 4, 5, 6 and so on. The rest of the table is devoted to the myriad bets the game entails. Betting is broken down into two major categories, inside bets and outside bets. There is no limit to the number of bets one can play Inside Bets Straight Bets This is betting that one particular number on the wheel will come up. This bet is done by placing a chip on top of the number on which you want to bet. If that number wins, the payoff is 35 to 1.

Split Bets

This is betting that one of two numbers that lie next to each other on the table will win. Placing a chip on the line that separates two numbers does this. You win if the ball lands on either number. The payoff is 17 to 1.

Street Bet, Trio Bet, or Three Number Bet

In this bet, a player is wagering that any number in a particular row will hit on the next spin. To make this bet, you must place a chip in the outside line of the row on which you want to bet. You win if any number in the row comes up. The payoff is 11 to 1.

Corner Bet, Square Bet, or Four-Number Bet

This bets that one of four numbers will hit on the next spin. The numbers should all be touching and moving a chip into the center of four numbers places the bet. If one of these numbers comes up, you win. This bets pays 8 to 1.

Five-Number Bet

This is betting that either the 0, 00, 1, 2, or 3 will come up on the next roll. To take this bet, place a chip on the outside line that divides the 0 and 1. You will be paid 6 to 1 if any of these numbers come up.

Six Line Bet

This is betting that one of six numbers in two adjacent rows will come up. Place a chip in between two rows on the outside line. If the ball lands on any number in the two rows, you will be paid 6 to 1.

Outside Bets

Red

You are betting that the next number to come up is a red. If the next number landed is red, you will be paid 1 to 1, or even money. To play this bet, place a chip on the box marked "Red".

Black

You are betting that the next number to come up is a black. If the next number landed is black, you will be paid 1 to 1, or even money. To play this bet, place a chip on the box marked "Black".

Even

This is wagering that the ball will land on an even number. This bet does not include 0 or 00. The payoff is 1 to 1. To play this bet, place a chip on the box marked "Even".

This is wagering that the ball will land on an odd number. The payoff is 1 to 1 if the next number to come up is odd. To play this bet, place a chip on the box marked "Odd".

Low Bet

This is a bet that the next number will be between 1 and 18. The payout is 1 to 1. To play this bet, place a chip on the box marked "Low".

High Bet

This is a bet that the next number will be between 19 and 36. The payout is 1 to 1. To play this bet, place a chip on the box marked "High".

Dozen Bet

These bets divide the table into the numbers 1-12, 13-24, and 25-36. To play this bet, put a chip in one of the three boxes marked "1st 12", "2nd 12" or "3rd 12". This bet pays 2 to 1.

Column Bet

This bets that a number in a particular column will come up on the next spin. The payoff is 2 to 1 and is done by placing a chip at the end of the layout below your desired column where it is marked "2 to 1".

English Roulette

The major difference between English and American Roulette is that English has only a 0 instead of both 0 and 00.

Sic Bo

Sic Bo is an ancient Chinese game meaning 'Dice Pair'. It is played in Southeast Asia, Korea, Nevada and Australia. It is also popular in the Philippines, where it is called 'Hi-Lo'. Sic Bo is played with three dice. The object of the game is to select the individual numbers, or combinations of numbers, that will appear on the dice after the 'throw'.

The possibilities include single dice numbers, two of a kind, three of a kind, or combinations of any two or three of the dice. These are displayed along with payoff odds on the table's layout.

To start, the players make their selection of a possible outcome and place a bet on a chosen possibility. After the bets are made, the dice tumbler is rotated and then set on the table. All winning possibilities of the three dice appear illuminated on the layout.

Winning payoffs range from 1:1 even money for one-of-a-kind, to 180:1 for a specific trio.

Slot Machine Games

Slot machine games are common in all the casino resorts. The rules and general steps of playing a slot machine game is described below:

1. Click "Insert Money" to begin playing.
2. Place one's bet by choosing credits in the denominations offered. The player can usually adjust his/her bet on the left side of the slot machine.
3. View one's balance in the slot machine's credit box.
4. The player can bet the maximum limit by clicking on "Bet Max."
5. If the player does not want to bet the maximum, he/she can click on "Bet One" for individual credits.
6. If the player hits a winning combination, he/she can see your payout on the Payout Table. To check and see how much he/she has won, click on the "Winner Paid" icon.
7. It's usually possible to switch machines while playing the same game. Check for a "Switch Machine" button if you want to try your luck somewhere else.

Description of the Gaming System

The gaming system described herein can be in any design. FIGS. 1A-1F show an embodiment of the present invention.

In FIG. 1A, the gaming system includes a main cabinet 100, a server (not shown), screen 200, screen 300, screen 400, and betting terminal 500. The server can be a stand alone server or included in main cabinet 100 and can include a chip, a memory, and optionally a database. The server is either commercially available or can be readily constructed by a person of ordinary skill in the art. Screens 200, 300 and 400 can display live casino games or non-live casino games. Betting terminal 500 comprises mechanisms (not shown) that allow a player to place a bet on a live casino game or a non-live casino game. The gaming system also includes a mechanism for selecting one or more live casino game(s) (not shown) and a mechanism for playing the one or more live casino game(s) (not shown). The gaming system can also include a mechanism for selecting one or more non-live casino game(s) (not shown) and a mechanism for playing the one or more non-live casino game(s) (not shown). Note, the mechanisms for selecting or playing one or more live or non-live casino game(s) can be included in any place in the gaming system.

FIG. 1B shows the bottom view of the gaming system shown in FIG. 1 A.

Figure 10:
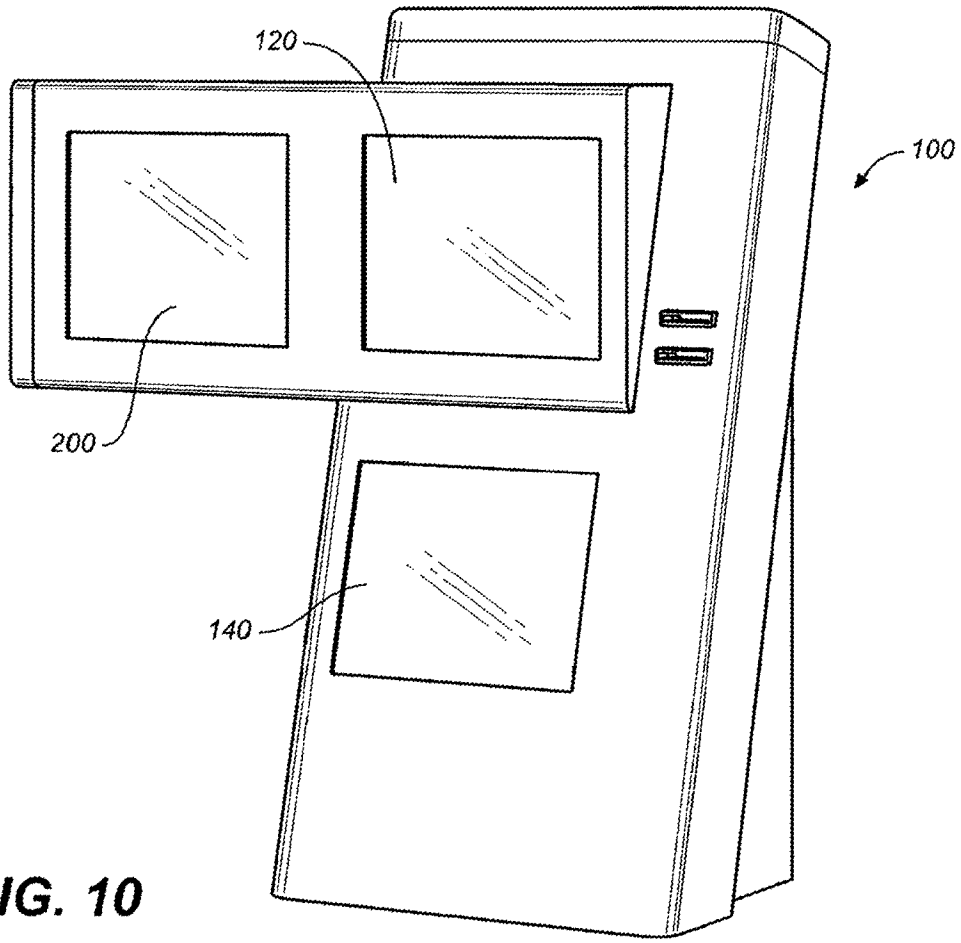
FIG. 10 shows an embodiment of the present invention where a screen for displaying 10 a slot machine game being connected to and extended from the upper screen of the main cabinet of a live baccarat gaming system.

FIG. 10 shows the top view of the gaming system shown in FIG. 1 A.

FIGS. 1D-1 E show two perspective views of the gaming system shown in FIG. 1A.

FIG. 1F shows the side view of the gaming system shown in FIG. 1A.

Figure 1G:
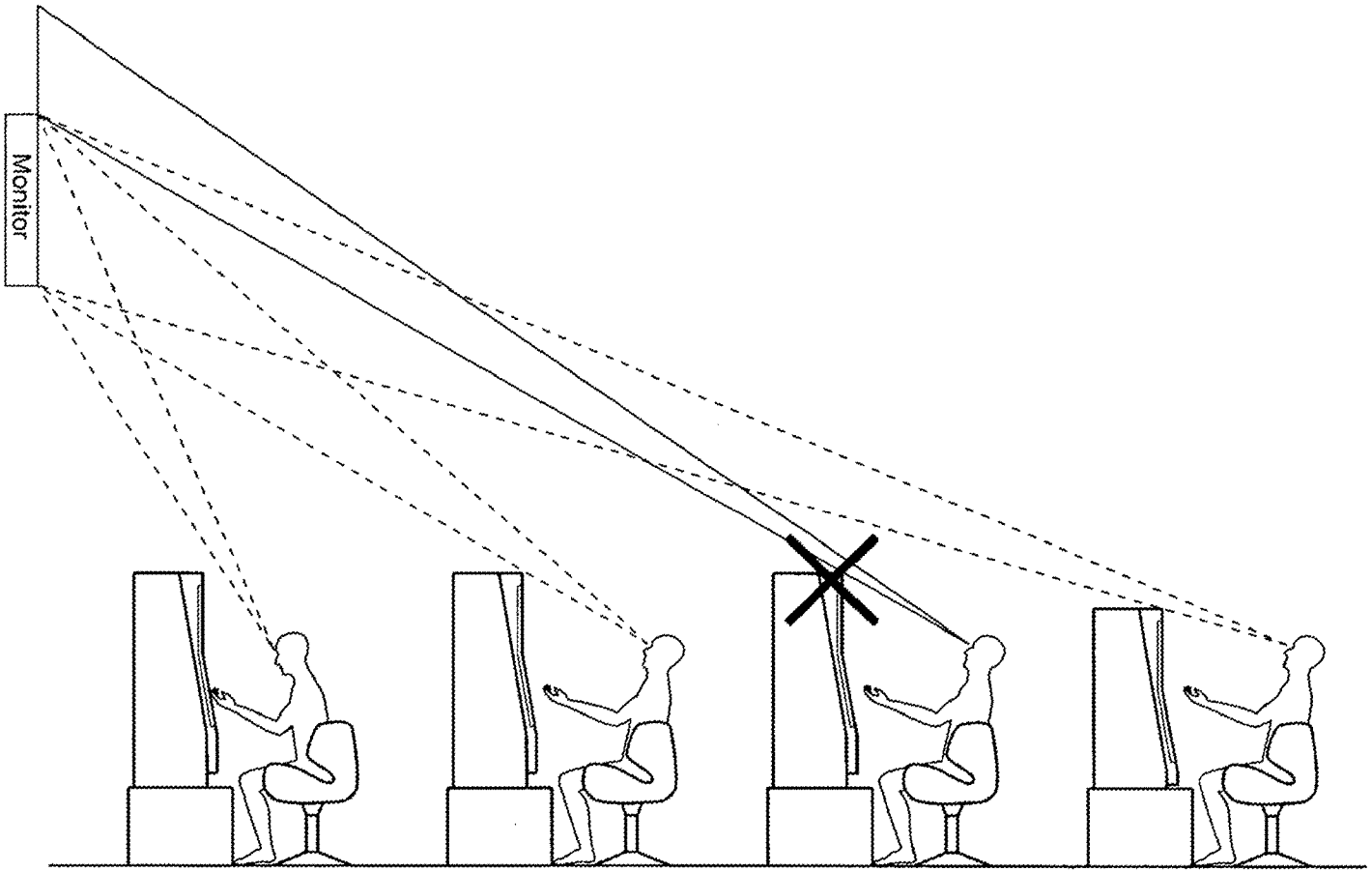
FIG. 1G illustrates a live baccarat player in the count down time of a live baccarat game.

FIG. 1G illustrates a live baccarat player in the count down time of a live baccarat game.

Figure 2:
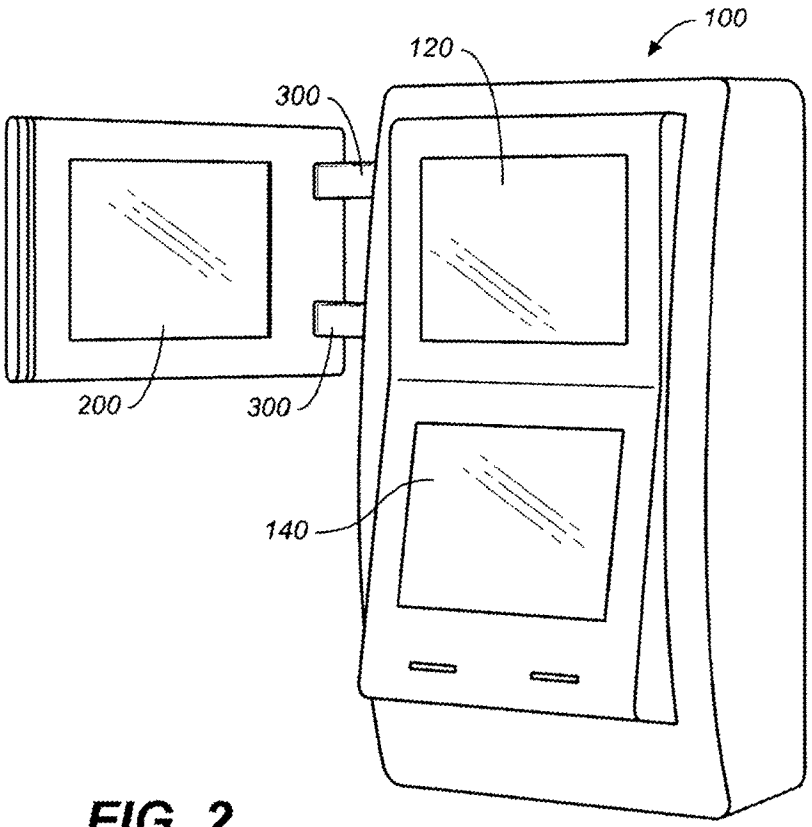
FIG. 2 shows an embodiment of the present invention where a screen for displaying a slot machine game being connected to the upper screen of the main cabinet of a live baccarat gaming system via two hinges.
Figure 3:
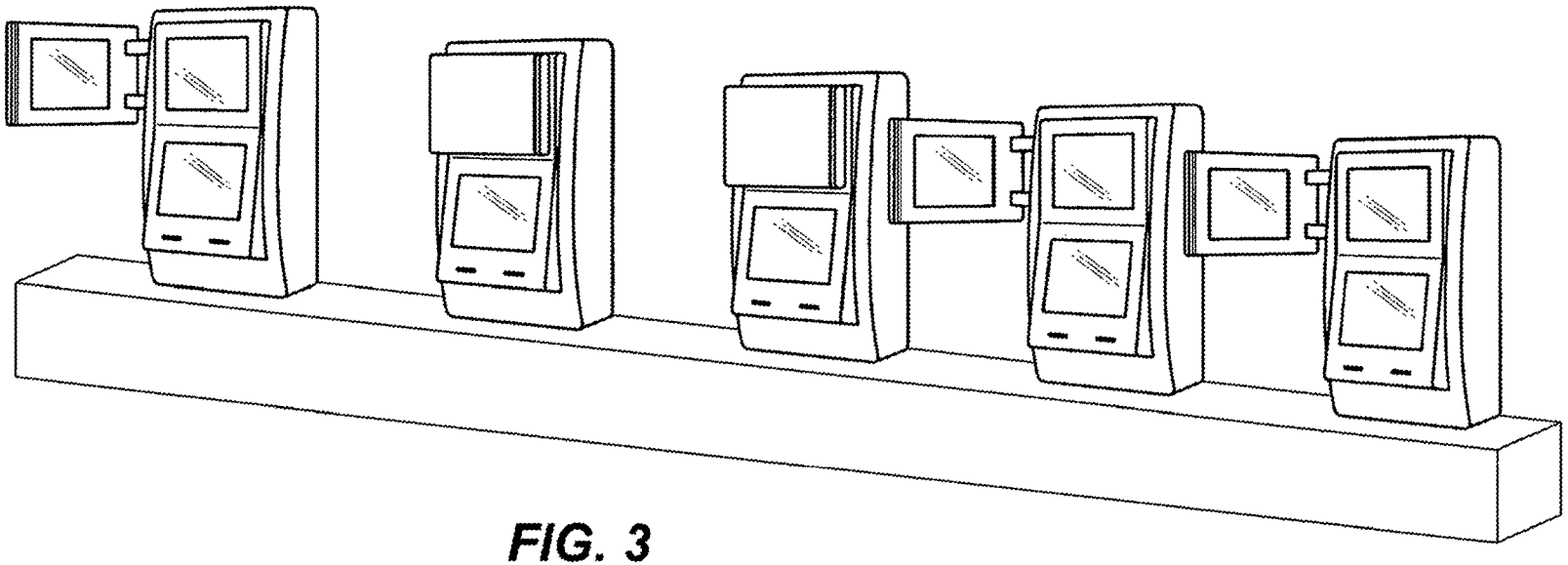
FIG. 3 shows the gaming system of FIG. 2 in a cluster.

The various embodiments of the present invention are described in reference to FIGS. 2-11. Referring to FIG. 2, the gaming system described herein includes a main cabinet 100, which includes an upper screen 120 and a lower screen 140, a screen 200 for displaying slot machine games, and two hinges 300 connecting screen 200 to main cabinet 100. Screen 200 is foldable and can be folded to cover upper screen 120 (FIG. 3). FIG. 3 shows the gaming system of FIG. 2 in a cluster, whereby a plurality of players can use the gaming system to play a game and a slot machine game. It is also envisioned that the screens are not separate screens, but portions of a screen within a single screen.

Figure 4:
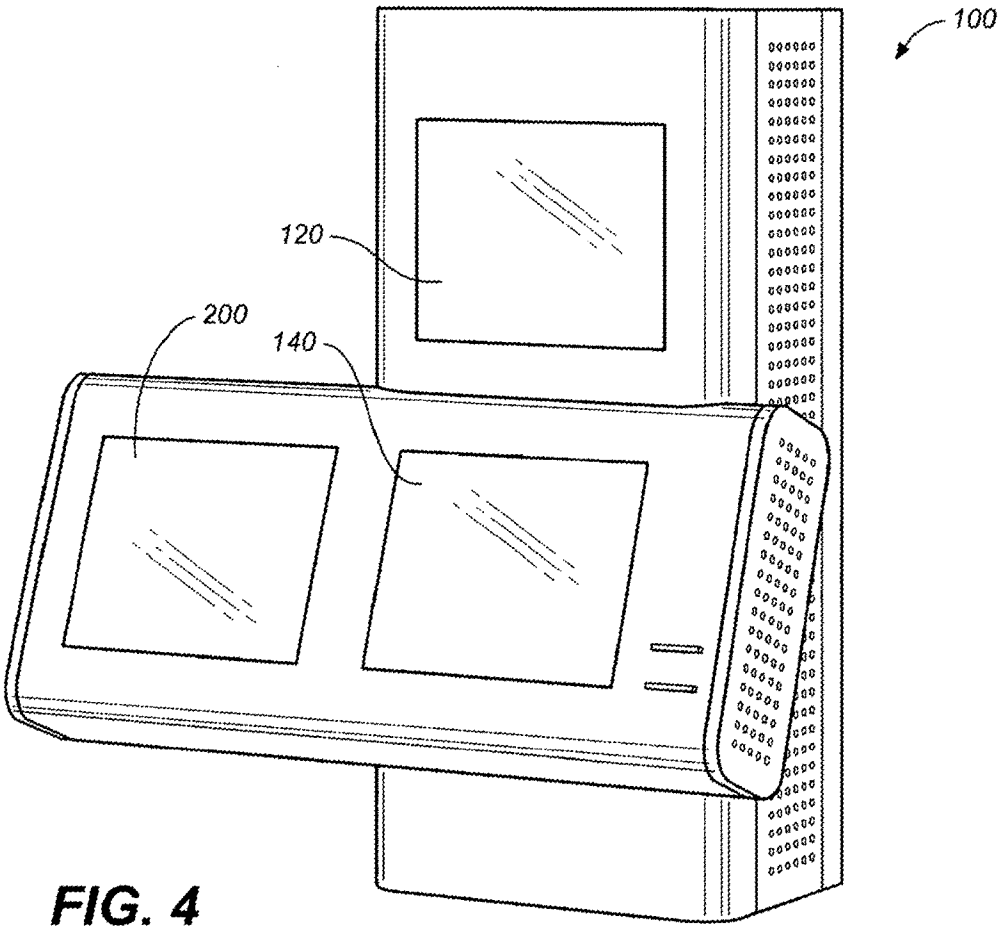
FIG. 4 shows an embodiment of the present invention where a screen for displaying a slot machine game is connected to and extended from the lower screen of the main 20 cabinet of a live baccarat gaming system.

Referring to FIG. 4, the gaming system includes a main cabinet 100, which includes an upper screen 120 and a lower screen 140, and a screen 200 for displaying slot machine games. The screen 200 is connected to and integratedly extended from lower screen 140 such that screen 200 and lower screen 140 become a single body.

Figure 5:
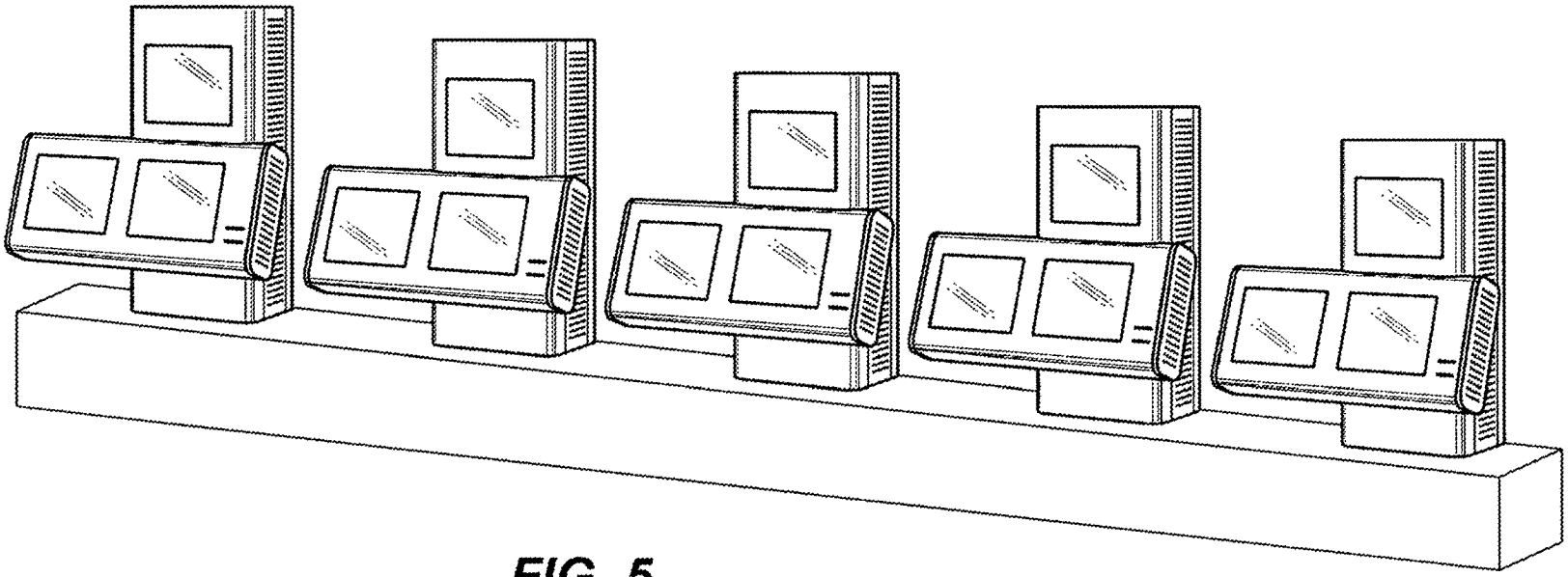
FIG. 5 shows the gaming system of FIG. 4 in a cluster.

FIG. 5 shows the gaming system of FIG. 4 in a cluster, whereby a plurality of players can use the gaming system to play a game and a slot machine game.

Figure 6:
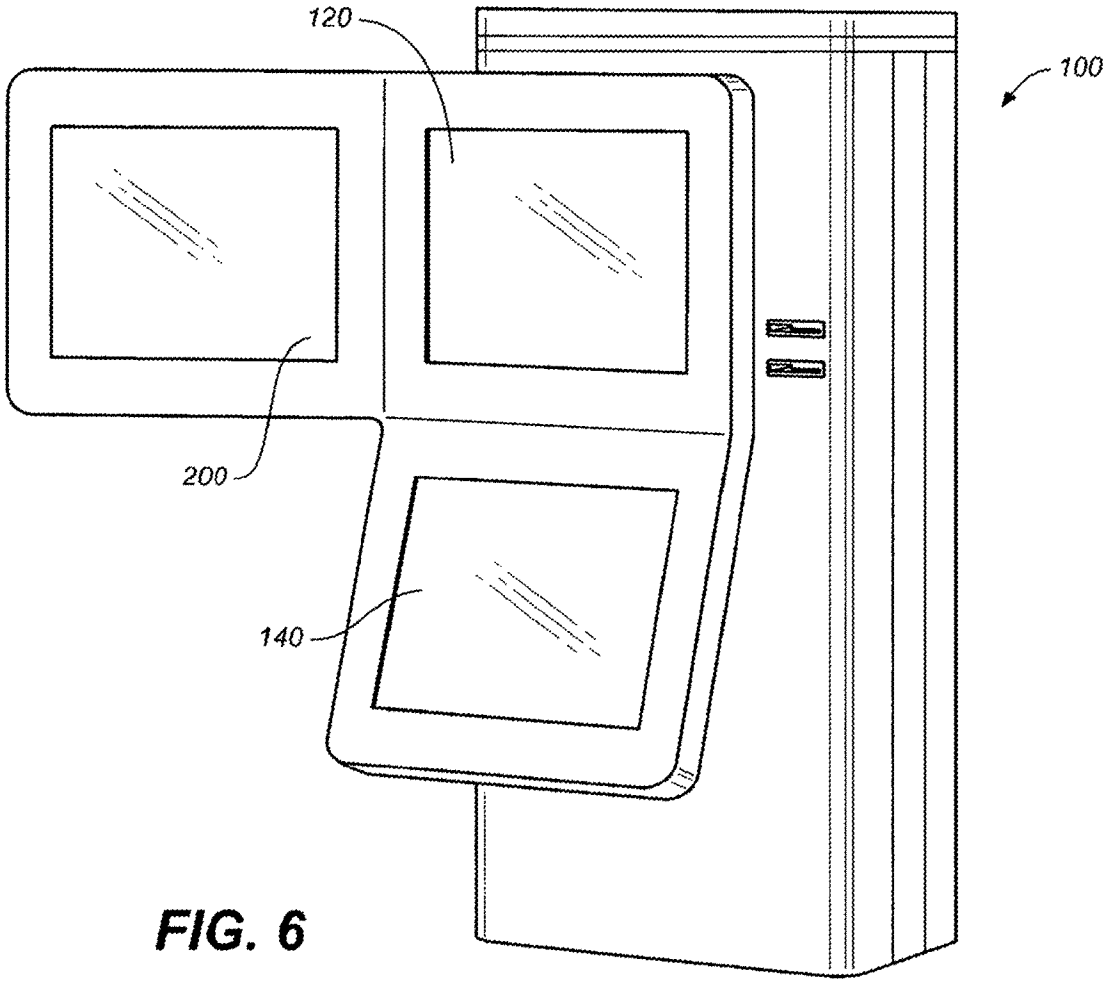
FIG. 6 shows an embodiment of the present invention where a screen for displaying a slot machine game is connected to and extended from the upper screen of the main cabinet of a live baccarat gaming system.
Figure 7:
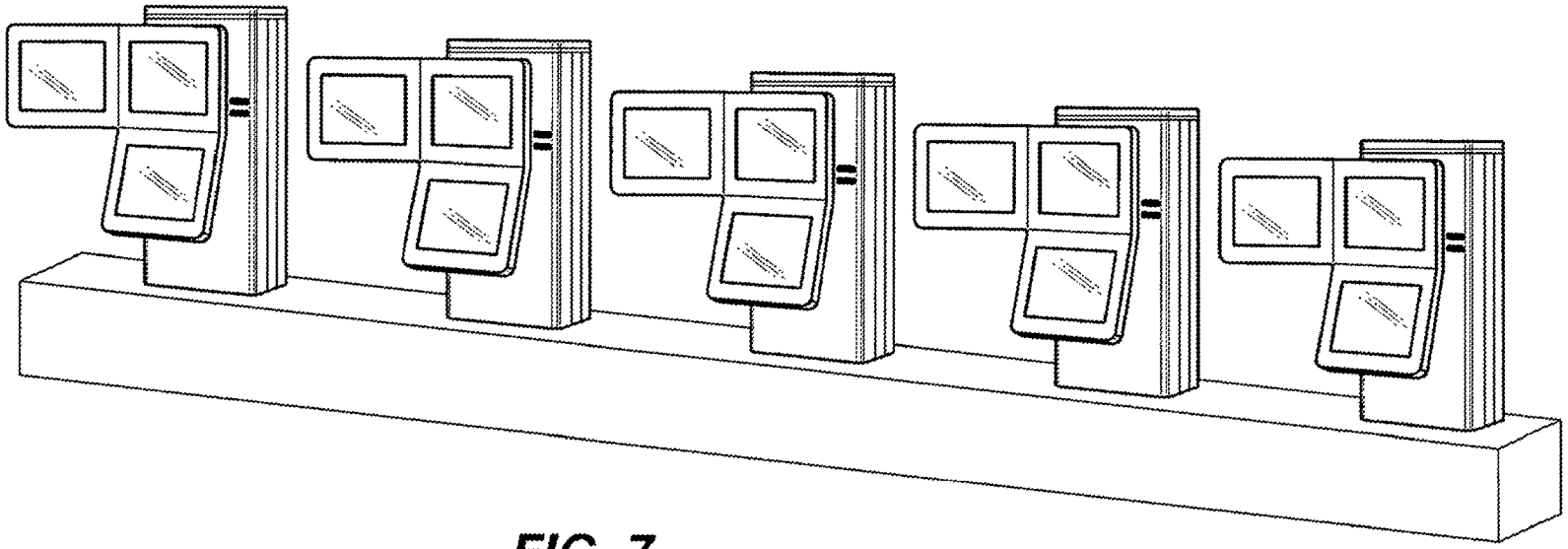
FIG. 7 shows the gaming system of FIG. 6 in a cluster.

Referring to FIG. 6, the gaming system includes a main cabinet 100, which includes an upper screen 120 and a lower screen 140, and a screen 200 for displaying slot machine games. The screen 200 is connected to and integratedly extended from upper screen 120 such that screen 200 and upper screen 120 become a single body. FIG. 7 shows the gaming system of FIG. 6 in a cluster, whereby a plurality of players can use the gaming system to play a game and a slot machine game.

Figure 8:
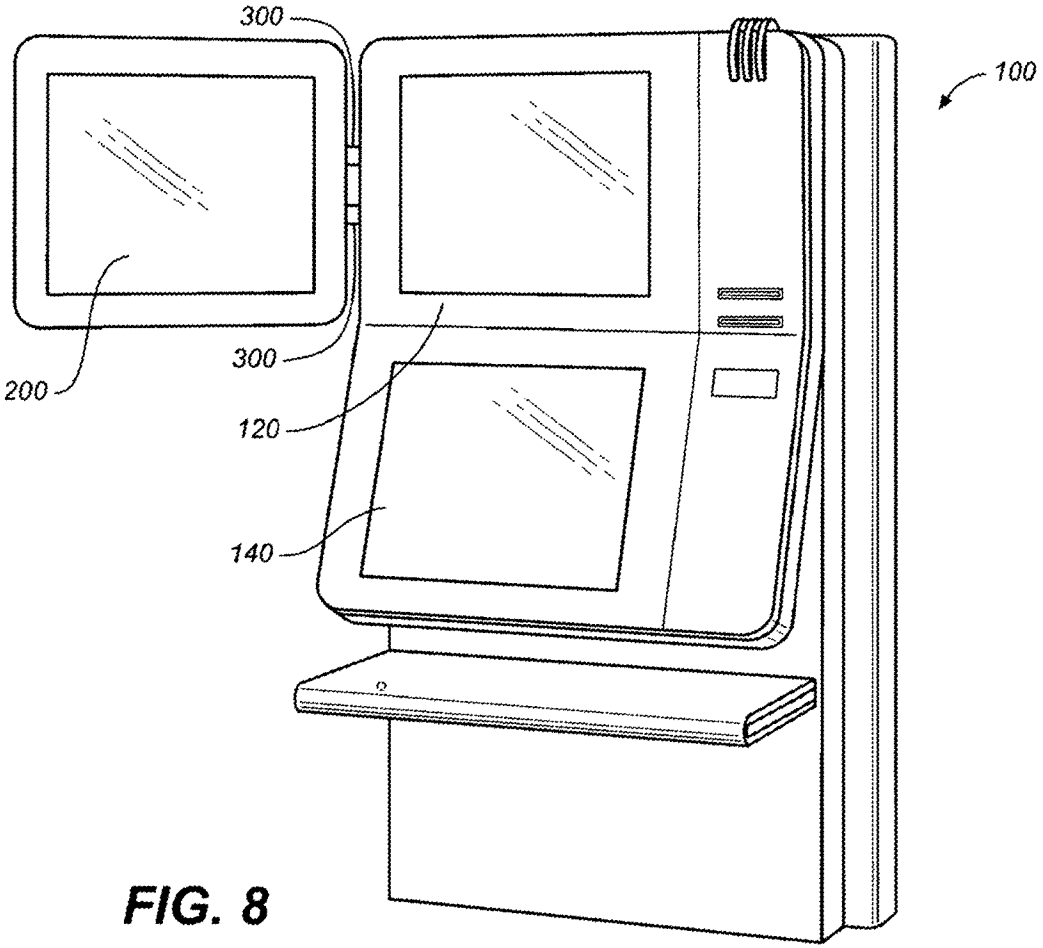
FIG. 8 shows an embodiment of the present invention where a screen for displaying a slot-machine game being connected to the upper screen of the main cabinet of a live baccarat gaming system via two metallic arms.
Figure 9:
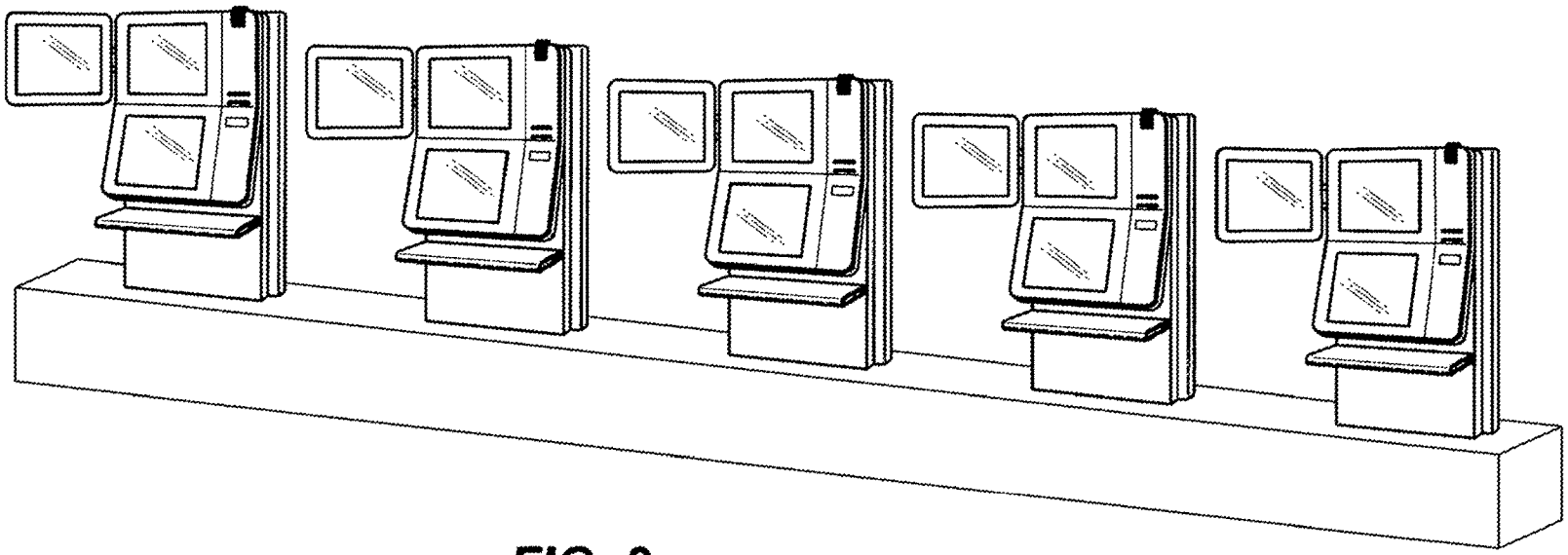
FIG. 9 shows the gaming system of FIG. 8 in a cluster.

Referring to FIG. 8, the gaming system described herein includes a main cabinet 100, which includes an upper screen 120 and a lower screen 140, a screen 200 for displaying slot machine games, and two metallic arms 300 connecting screen 200 to main cabinet 100 by the side of upper screen 120. FIG. 9 shows the gaming system of FIG. 8 in a cluster, whereby a plurality of players can use the gaming system to play a game and a slot machine game.

Figure 11:
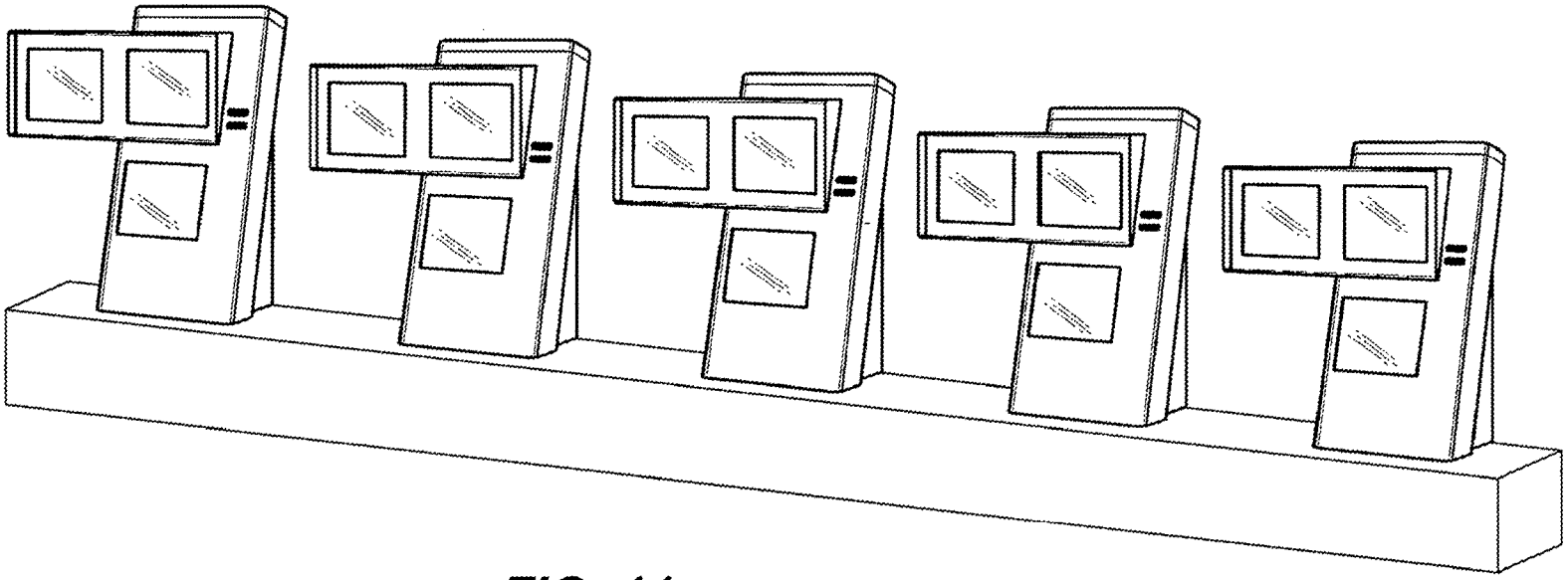
FIG. 11 shows the gaming system of FIG. 10 in a cluster.

Referring to FIG. 10, the gaming system includes a main cabinet 100, which includes an upper screen 120 and a lower screen 140, and a screen 200 for displaying slot machine games. The screen 200 is connected to and integratedly extended from upper screen 120 such that screen 200 and upper screen 120 become a single body. In relation to the surface plane of the main cabinet, upper screen 120 and screen 200 are out of the surface plane of the main cabinet, and lower screen 140 is in the surface plane of the main cabinet. FIG. 11 shows the gaming system of FIG. 10 in a cluster, whereby a plurality of players can use the gaming system to play a game and a slot machine game.

Figure 12A:
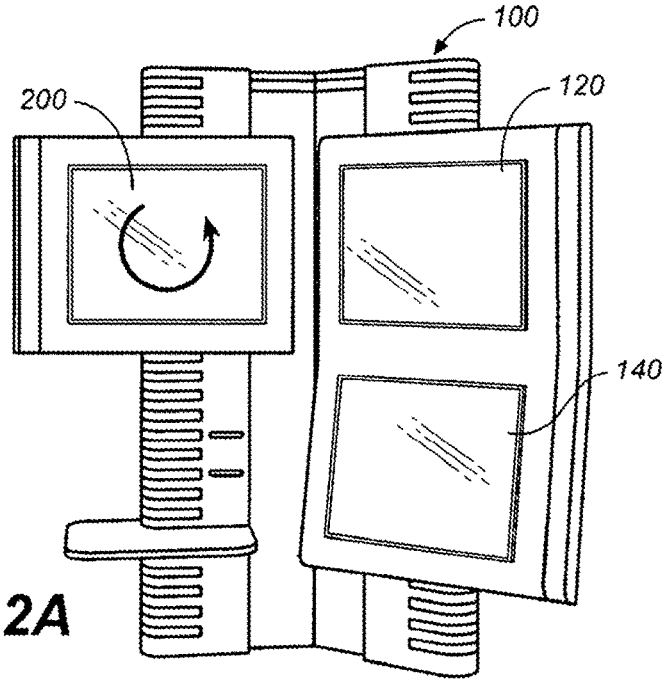
FIGS. 12A and 12B show an embodiment of the present invention where a screen for displaying a slot machine game being attached the main cabinet of a live baccarat gaming system.
Figure 12B:
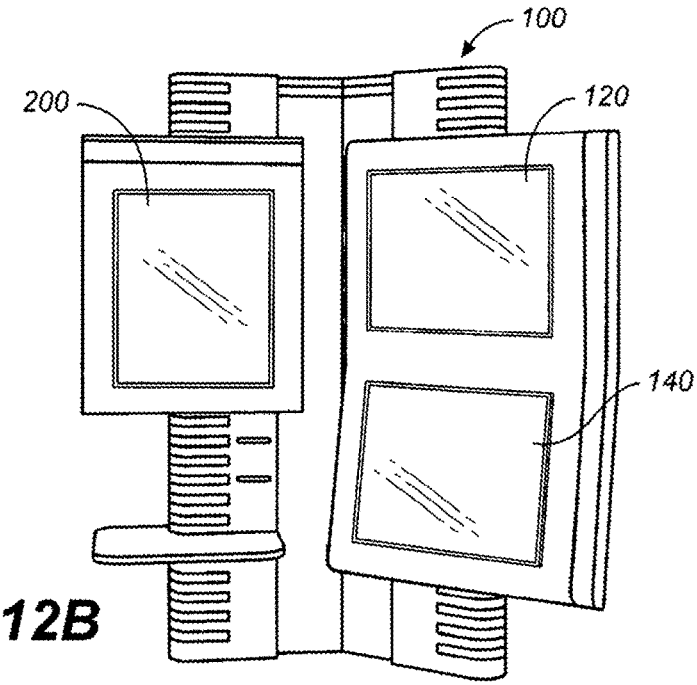

Referring to FIGS. 12A and 12B, the gaming system includes a main cabinet 100 having an upper screen 120 and a lower screen 140 connected or otherwise attached thereto. A screen 200 for displaying a slot machine game is attached to the main cabinet 100 by the side of the upper screen 120. In some embodiments, the screen 200 can be attached to the main cabinet 100 by the side of the lower screen 140. In some embodiments, the screen 200 can be rotated (FIG. 12A) to have an angle (e.g., 90 degree) in relation to screen 120 or screen 140. The screen for displaying a slot machine game of the various embodiments described above can be fixed or folded. A person of ordinary skill in the art can readily construct a gaming system or device according to the above description.

Referring to FIGS. 13A and 13B, a layout for the gaming system described herein is shown in FIGS. 13A and 13B. FIGS. 13A and 13B show the overall layout of the betting terminal which has two portions of screens, the upper screen portion (1400) and the lower screen portion (1500), shown in detail in FIGS. 13A and 13B. Referring to FIG. 13A, upper screen portion 1400 includes an upper part (1410) for displaying the result, score and latest jackpot amount, the center part (1420) for displaying a live video of the gambling table, and a messenger screen (1430) for displaying messages. In one embodiment, the jackpot amount digits can be programmed to be in rolling motion to reflect the increasing jackpot pool. The center part of the upper screen has a section designated as Player (1440), which has a small screen (1450), and another section designated as Banker (1460), which also has a small screen (1470). The small screens 1450 and 1470 are for display of card values of the player hand and the bank hand respectively. The current amount of total wagers on Player (player hand) and Bather (bank hand) in a live baccarat game are shown in small screens 1480 and 1490 below small screens 1450 and 1470, respectively. Of course, any live table game could be displayed, as will be appreciated by those of skill in the art.

Referring to FIG. 13B, the lower screen portion 1500 may be an operating touch screen for betting, which includes bet-option buttons (1510), bet-amount buttons (1520), and credit window (1530). The bet-option buttons 1510 include the various betting selections described above, e.g., betting for player hand (1511) win with a payoff rate of 1:1, for the bath hand (1512) win with a payoff rate of 1:0.95, for tie (1513) with a payoff rate of 1:8, for Player Pairs (1514) with a payoff rate of 1:11, for banker pairs (1515) with a payoff rate of 1:11, and for Jackpot bet (1516), the rules of which are described above. Box 1517 shows the pops up when bets are placed on a particular bet option. The number inside Box 1517 corresponds to the amount placed on a particular bet option. The bet-amount buttons 1520 as shown in the layout, 100, 500, 1000, 5000, 10000, provide the players the convenience of adding up betting amounts in a fast manner To illustrate, for a bet of 10,000 USD or HKD, the player can simply press the "1000" button ten times to reach the desired betting amount. Note, the bet-amount buttons 1520 shown are illustrative and non-exclusive. Buttons designated for other amounts, e.g., "1", "5", "10", "100", "100,000", "1,000,000" can be readily added to the screen. The credit window 530 shows the remaining balance of a player's credit. The player may insert bills or chips into or transfer money from a credit card account and/or a bank account to the machine to add up the credit amount from time to time. If the player desires to stop playing the baccarat game and to cash out, he may ask the operator to authorize a cash-out procedure, and then obtain the remaining balance. Once results of a game are confirmed, the losing bet shown in the bet option buttons (1510) in the center of lower screen will disappear while the winning bet in the bet option buttons (1510) in the lower screen will flash with the total amount won.

Figure 13C:
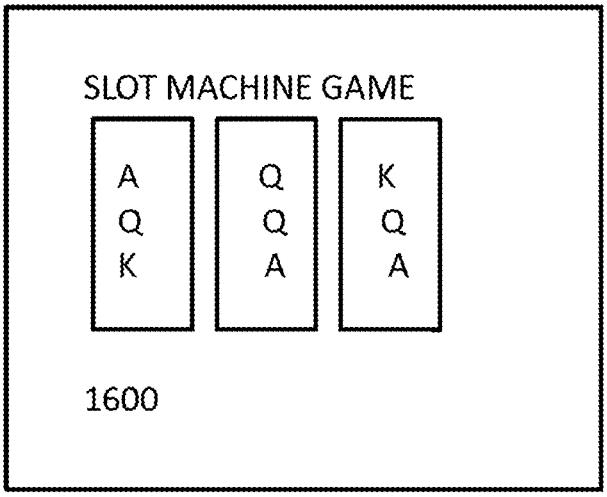

Still referring to FIG. 13B, the lower screen portion 1500 further includes language selection button (1540), which can switch the operation language of the baccarat game between, e.g., English, Portuguese, Italian, French, Spanish, Russian, German, Arabic, Japanese, and Korean, etc, Rule selection button (1550), which prompts the display of rules for live baccarat and Paradise Jackpot, Cancel button (1560), which allows the bettor to cancel all bets made before the cards are dealt, Operator button (1570), which allows the bettor to call for assistance from the casino staff when there is machine failure or the bettor wishes to exit from the game, and Results Bars (1580, 1590) which display the results for previous live baccarat games. The results bars (1580, 1590) shows history for each table providing a results history display. For example, results bar 1580 shows the past game results for approximately 30 games played at a single table. By way of example, for the game of Baccarat the results history may be shown by way of a display results bar that shows player, banker and tie results as well as player or banker pairs natural results—all shown with an explanation of the symbols and running tally of results. Results bar 1590 area shows the results history for three (3) tables (1592, 1594, 1596). The results bar 1580 shows the results for another table, which may be for the table that is currently being played, which is why it appears larger and has a larger number results from past games played. The player may switch between games by touching the results bar that corresponds to the table they want to play at. This allows for significantly reduced down time. During any period of inactivity (for example during dealing, or waiting for bets to be placed at one table) the player can switch to another table quickly and easily and virtually play at that table. This increases the play for the player, adding to a sense of excitement. For the casinos, it is also highly profitable. Table games require dealers and the number of places are limited by gaming regulations and the physical space around a table. The gaming system of the present invention allows more players to play at the tables, as they are not physically at the table. There may be another second additional portion of the screen in the main cabinet for playing a casino slot machine game 1600, as shown in FIG. 13C. It should be understood FIGS. 13A, 13B and 13C are each separate portions of a screen. They may be within one screen as portions within one screen, or within separate screens viewable to a player (for example as shown in FIG. 5).

The main cabinet may also be a betting terminal and be an electronic device of entertainment gaming machine. For example, this could be a desktop computer, a cellphone, a hand held personal computer, a smart phone, a tablet or a handheld person digital assistant.

While particular embodiments of the present invention have been shown and described, it will be obvious to those skilled in the art that changes and modifications can be made without departing from this invention in its broader aspects. Therefore, the appended claims are to encompass within their scope all such changes and modifications as fall within the true spirit and scope of this invention.

The invention is claimed as follows:

1. A gaming terminal comprising:

an input device;

a display device;

a processor; and a memory device which stores a plurality of instructions, which when executed by the processor, cause the processor to:

receive, via the input device, an input to play at least one live casino game selected from a plurality of live casino games being played at a plurality of gaming tables, wherein the plurality of gaming tables are each spaced away from the gaming system;

after receiving, over a network, data associated with the at least one live casino game, cause at least a first portion of the display device to displays the play of the at least one live-casino game at at least one of the gaming tables, and after causing at least the first portion of the display device to display a results history display comprising a results history for each of the plurality of gaming tables, receive a player input, via a switching mechanism, to switch between causing at least the first portion of the display device to display the play the at least one live casino game and causing the display device to display a play of at least one game not being played at any of the plurality of gaming tables.

2. The gaming terminal of claim 1, wherein when executed by the processor, the instructions cause the processor to cause at least one second additional portion of the display device to display the at least one game not being played at any of the plurality of gaming tables.

3. The gaming terminal of claim 2, wherein the first portion of the display device and the at least one second additional portion of the display device comprises an upper screen and a lower screen.

4. The gaming terminal of claim 3, wherein the upper screen and the lower screen are connected through a connection mechanism.

5. The gaming terminal of claim 4, wherein the connection mechanism comprises at least one of: at least one hinge and at least one arm.

6. The gaming terminal of claim 1, wherein the at least one live casino game is selected from the group consisting of: a live baccarat game, a felt-table game, poker game, a Sic Bo game, a Roulette game, a Fish-Prawn-Crab game, and a Wheel of Fortune game.

7. The gaming terminal of claim 1, wherein the at least one game not being played at any of the plurality of gaming tables is a video server based game.

8. The gaming terminal of claim 7, wherein the at least one game not being played at any of the plurality of gaming tables is a video server based reel game.

9. The gaming terminal of claim 1, wherein the switching mechanism to switch to another one of the live casino games comprises a touch screen.

10. The gaming terminal of claim 1, wherein the switching mechanism to switch to the at least one games not being played at any of the plurality of gaming tables comprises a touch screen.

11. The gaming terminal of claim 1, wherein the display device is selected from the group consisting of: a display device of a cellphone, a display device of a smart phone, a display device of a tablet and a display device of a handheld personal digital assistant.

12. A gaming system comprising:

a processor; and a memory device which stores a plurality of instructions, which when executed by the processor, cause the processor to:

communicate data to a betting terminal to enable a player at the betting terminal to play at least one live casino game selected from a plurality of live casino games played at a plurality of gaming tables, wherein the plurality of gaming tables are each spaced away from the betting terminal, communicate data, over a network, to the betting terminal to cause at least a first portion of a display device of the betting terminal to display: (i) the play of the live-casino game, and (ii) a results history display comprising a results history for each of the plurality of gaming tables; and receive data associated with a player input made, via a switching mechanism, to switch between playing the at least one live casino game and playing at least one game not being played at any of the plurality of gaming tables, wherein the player input is based, at least in part on the results history for each of the plurality of gaming tables.

* * * * *